United States Patent [19]

Gibisch et al.

[11] 4,444,162

[45] Apr. 24, 1984

[54] INTERNAL COMBUSTION ENGINE WITH A SECONDARY AGGREGATE

[75] Inventors: Hans Gibisch, Munich; Joachim Hahn, Wolfratshausen; Richard Henning, Munich; Waldemar Jende, Groebenzell, all of Fed. Rep. of Germany

[73] Assignee: Bayerische Motoren Werke Aktiengesellschaft, Munich, Fed. Rep. of Germany

[21] Appl. No.: 367,555

[22] Filed: Apr. 12, 1982

[30] Foreign Application Priority Data

Apr. 10, 1981 [DE] Fed. Rep. of Germany ..... 3114690

[51] Int. Cl.[3] ..... F02B 77/00

[52] U.S. Cl. ..... 123/198 C; 123/195 A; 123/195 C

[58] Field of Search ..... 123/198 C, 195 A, 195 C, 123/198 R

[56] References Cited

U.S. PATENT DOCUMENTS

| | | | |
|---|---|---|---|
| 3,991,735 | 11/1976 | Horstmann | 123/198 C |
| 4,054,108 | 10/1977 | Gill | 123/198 C |
| 4,080,945 | 3/1978 | Hikosaka et al. | 123/195 C |

FOREIGN PATENT DOCUMENTS

| | | | |
|---|---|---|---|
| 443328 | 4/1927 | Fed. Rep. of Germany . | |
| 8101593 | 6/1981 | Int'n Pat. Institute | 123/195 A |

*Primary Examiner*—Ira S. Lazarus

*Attorney, Agent, or Firm*—Craig & Burns

[57] ABSTRACT

An internal combustion engine which includes a secondary aggregate or unit such as, for example, a vacuum pump, located inside of a valve housing which is formed by a cylinder head and a cylinder head cover. A portion of the vacuum pump, for example, a connecting portion for a vacuum line leading to a consumer, extends outwardly through an opening or passage and forms a seal with the cylinder head cover.

9 Claims, 2 Drawing Figures

INTERNAL COMBUSTION ENGINE WITH A SECONDARY AGGREGATE

Figure 1:
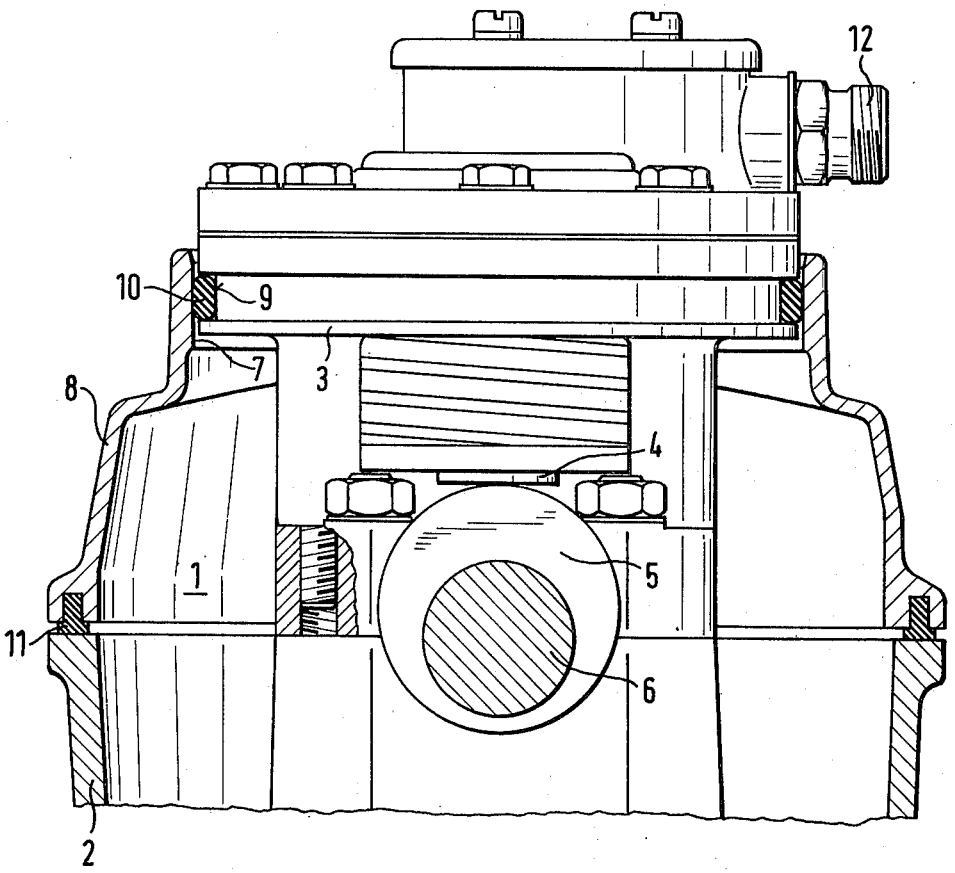

The present invention relates to an internal combustion engine and, more particularly, to an internal combustion engine equipped with a secondary aggregate or unit disposed in a valve housing. The secondary aggregate is adapted to be driven by a drive portion of a valve-operating mechanism of the engine, with the valve housing being attached to a cylinder head of the internal combustion engine.

In, for example, German Auslegeschrift No. 12 91 931 and 12 91 932, internal combustion engine constructions are proposed wherein a secondary aggregate or unit in the form of an air pump is arranged in a valve housing. The air pump is adapted to generate auxiliary air for the purposes of exhaust gas detoxification or pollution control. In these proposed constructions, the cylinder head cover itself forms a part of the air pump with a specially designed rocker arm being provided for actuating both a valve and the pump.

A disadvantage of the above proposed internal combustion engine constructions resides in the fact that not only is it necessary to provide a specially designed rocker arm, but also by virtue of the actuation of both the valve and the pump, additional loads are imposed on the rocker arm and the valve springs.

In German Offenlegungsshrift No. 24 37 946, a construction is proposed wherein an overhead camshaft is employed to drive secondary aggregates or units such as, for example, compressors, fuel feed pumps and fuel injection pumps which are mounted on the cylinder head from the outside thereof.

A disadvantage of the last-mentioned proposed construction resides in the fact that the secondary aggregates or units are not covered and, consequently, the aggregates or units are exposed to a fouling or contamination and also contribute to the production of noise during the operation of the engine.

The aim underlying the present invention essentially resides in providing an internal combustion engine of the aforementioned type wherein, especially when a cylinder head cover and cylinder head are acoustically decoupled, driving of the secondary aggregate or unit with as little play as possible is ensured while at the same time allowing a simple installation of the secondary aggregate or unit.

In accordance with advantageous features of the present invention, a cylinder head cover, covering a valve housing and adapted to be mounted on the cylinder head, is provided with at least one opening therein for accommodating a portion of the secondary aggregate or unit which may, for example, be in the form of a vacuum pump. The vacuum pump is arranged on the cylinder head in such a manner so as to enable an operating means thereof to be actuated by, for example, an eccentric means provided on a camshaft of the internal combustion engine.

It is also possible in accordance with the present invention, for the secondary aggregate or unit to be accommodated in the valve housing with a connection means of the secondary aggregate or unit extending through the opening provided in the cylinder head cover.

By virtue of the above-noted features of the present invention, it is possible to attach the secondary aggregate or unit to the cylinder head prior to an installation of the cylinder head cover and to maintain a drive connection between the valve operating means and the drive of the secondary aggregate or unit free of play to a relatively large extent. After the secondary aggregate or unit has been attached to the cylinder head, it is then possible for the cylinder head cover to simply be put on the secondary unit and, in this process, only a part of the secondary unit such as, for example, the connecting means, need extend out of the cylinder head cover.

Advantageously, in accordance with further advantageous features of the present invention, a seal is provided in the form of a packing for preventing metal-to-metal contact between the secondary aggregate or unit and the cylinder head cover. This is particularly significant when the cylinder head and cylinder head cover are acoustically decoupled.

With a construction wherein the connecting means in the form of, for example, a pipe connection or the like protruding through the cylinder head cover, in accordance with still further advantageous features of the present invention, and the position of the connection means which, having large dimensional tolerances, may be compensated for by utilizing a relatively large packing ring, be formed of a rubber or rubber-elastic material.

Accordingly, it is an object of the present invention to provide an internal combustion engine with a secondary aggregate or unit which avoids, by simple means, shortcomings and disadvantages encountered in the prior art.

Another object of the present invention resides in providing an internal combustion engine with a secondary aggregate or unit which simplifies the installation of the aggregate or unit.

Yet another object of the present invention resides in providing an internal combustion engine with a secondary aggregate or unit which enables a driving of the secondary aggregate or unit substantially free of play.

A still further object of the present invention resides in providing an arrangement for mounting a secondary aggregate or unit on an internal combustion engine which is simple in construction and therefore relatively inexpensive to manufacture.

Figure 2:
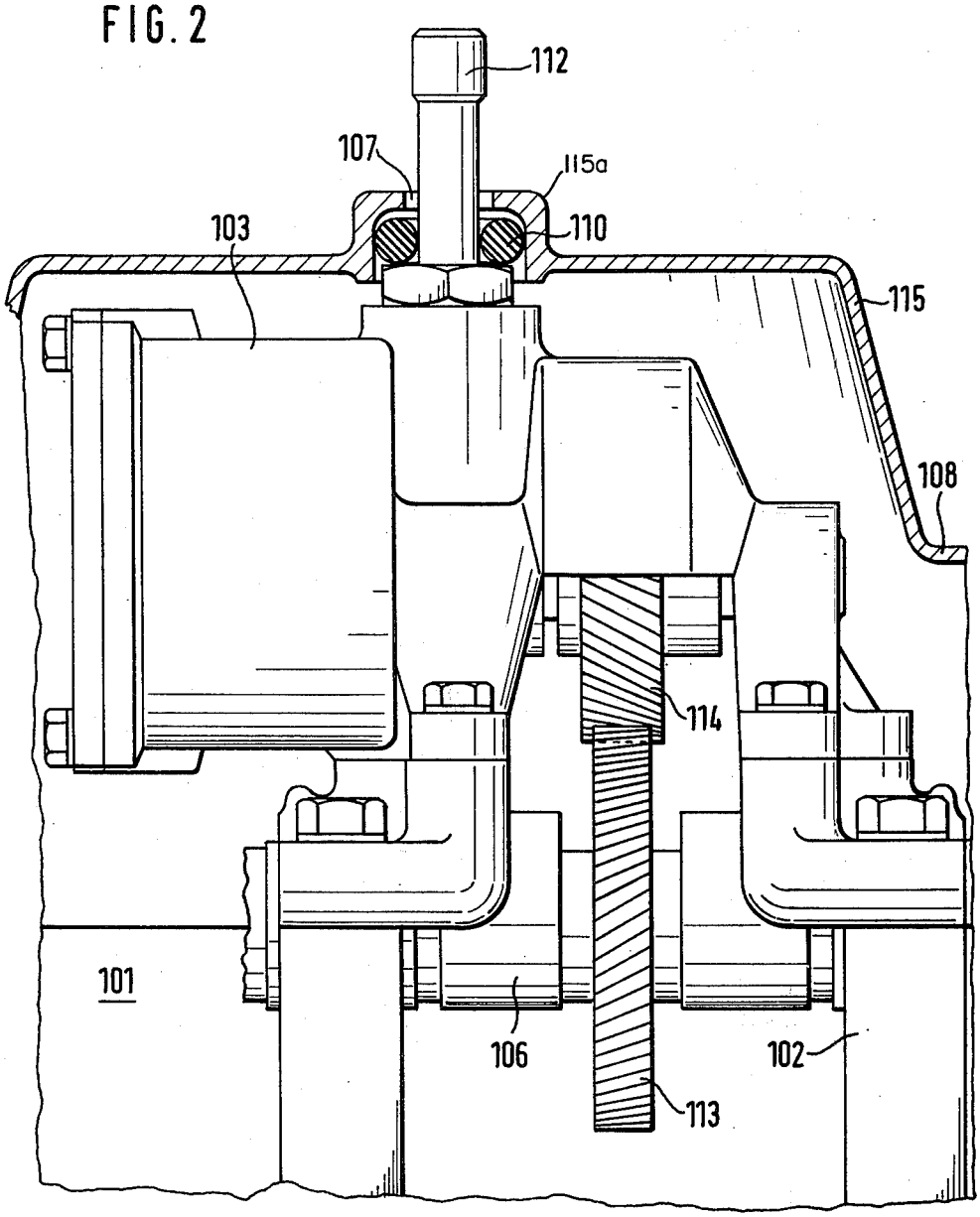

These and other objects, features, and advantages of the present invention will become more apparent from the following description when taken in connection with the accompanying drawings which show, for the purposes of illustration only, two embodiments in accordance with the present invention, and wherein:

FIG. 1 is a partial cross-sectional view of a cylinder head of an internal combustion engine equipped with a vacuum pump as a secondary aggregate or unit driven by an eccentric/tappet drive means; and FIG. 2 is a partial cross-sectional longitudinal view of a cylinder head of an internal combustion engine equipped with a gear-driven vacuum pump as a secondary aggregate or unit.

Referring now to the drawings wherein like reference numerals are used in both views to designate like parts and, more particularly, to FIG. 1, a secondary aggregate or unit such as, for example, a vacuum pump 3 extends into a valve housing 1 and is mounted to a cylinder head 2 of an internal combustion engine. The vacuum pump 3 may be constructed as a dipahragm pump and may be rigidily bolted or otherwise suitably fixed to the cylinder head 2. A tappet 4 of the vacuum pump 3 is arranged so as to be driven by an eccentric 5 provided on a camshaft 6 of the engine. A portion of the vacuum pump 3 extends outwardly through a passage or opening 7 provided in a cylinder head cover 8. The vacuum pump 3 is provided with a circumferential groove 9 in an area of the passage or opening 7, with the groove 9 being adapted to accommodate a sealing means in the form of, for example, an O-ring 10. The O-ring 10 forms a seal between the inner edges of the passage or opening 7 and the outer circumferential surface of the vacuum pump 3.

The cylinder head cover 8 is supported on the cylinder head 2 through a seal 11 accommodated in a groove in the cylinder head cover 8. The cylinder head cover 8 is attached to the cylinder head, in a conventional manner, by a bolt connection arrangement which is insulated against vibration. The portion of the vacuum pump 3 which extends outwardly through the passage or opening 7 includes an appropriate connection means for enabling a connection of the outlet of the vacuum pump 3 to appropriate consumers (not shown).

As shown in FIG. 2, a vacuum pump 103, constructed as a vane-cell pump, is rigidly connected to a cylinder head 102. The vacuum pump 103 is adapted to be driven by a camshaft 106 through helical gear wheels 113, 114. A cylinder head cover 108 is provided with a protrusion or bulge 115 so as to enable an accommodation of the vacuum pump 103 in the valve housing 101. A passage or opening 107 is provided at a protrusion 115*a* arranged at the peak or upper extremity of the bulge 115. A connecting means 112 of the vacuum pump 103 extends through the passage 107. A sealing means may be provided between an edge of the passage 107 and an outer circumference of the connecting means 112 or a large O-ring 110 formed as a packing ring may be provided so as to ensure no interference with any vibration insulation which may be present between the cylinder head cover 108 and cylinder head 102. The packing ring or large O-ring is preferably made of a rubber or rubber-elastic material.

In the embodiments of FIGS. 1 and 2, the vacuum pump 3 or 103 is attached to the cylinder head 2 or 102. After the pump 3 or 103 is installed in the valve housing 1 or 101, the cylinder head cover 8 or 108 may then simply be mounted on the cylinder head 2 or 102. This makes it possible to simply remove the cylinder head cover 8 or 108 to either adjust the vacuum pump 3 or 103 or to adjust the valve play without it being necessary to detach the drive of the vacuum pump 3 or 103.

While a secondary aggregate or unit has been described as a vacuum pump, as can readily be appreciated, the secondary aggregate or unit may, for example, take the form of a compressor, a fuel pump or a fuel injection pump as well as other types of aggregates or units of an internal combustion engine.

While we have shown and described only two embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such changes and modifications as are encompassed by the scope of the appended claims.

We claim:

1. An internal-combustion engine having an auxiliary aggregate driven by means of a driving part of the valve drive, with said auxiliary aggregate being fastened on the cylinder head cover of the internal-combustion engine, characterized in that the auxiliary aggregate is a vacuum pump, that the cylinder head cover has a passage opening and that a connecting branch of the vacuum pump projects through the passage opening in an elastically sealing engagement with the cylinder head cover.

2. An internal-combustion engine according to claim 1, characterized in that between a collar surface and the outside circumference of the connecting branch and the inside limits of the passage opening, a large-volume sealing ring is disposed that is made of a rubber-elastic material.

3. An internal combustion engine according to claim 2, wherein said sealing ring is constructed as a large O-shaped ring.

4. An internal combustion engine according to one of claims 1 or 3, wherein the connecting branch of the auxiliary aggregate is a connection means for enabling a connection of the auxiliary aggregate with a consumer.

5. An internal combustion engine according to one of the claims 1 or 3, wherein the vacuum pump includes an operating means, and the driving part includes an eccentric means provided on a camshaft of the engine cooperable with the operating means.

6. An internal combustion engine according to one of claims 1 or 3, wherein the vacuum pump means and the driving part includes a gear means for operatively connecting the vacuum pump and a camshaft means of the driving part.

7. An internal combustion engine having a cam shaft, a cylinder head, a cylinder head cover, and an auxiliary aggregate comprising driving means on said cam shaft for actuating said auxiliary aggregate and driven means on said aggregate means for engagement by said driving means, said auxiliary aggregate being fixedly secured to said cylinder head and including a projecting connecting branch, said cylinder head cover including an opening for receiving the connecting branch therethrough, means for sealing disposed between said auxiliary aggregate and said cylinder head cover, whereby said auxiliary aggregate is actuated by said driving means of said cam shaft engaging the driven means in a manner substantially free of play.

8. An internal combustion engine as set forth in claim 7, wherein said means for sealing is a generally O-shaped ring of elastomeric material.

9. An internal combustion engine as set forth in claim 7, wherein said means for sealing is elastomeric whereby the cylinder head cover is substantially acoustically isolated from said cylinder head by said sealing means.

* * * * *